US009119460B2

(12) United States Patent
Ables

(10) Patent No.: US 9,119,460 B2
(45) Date of Patent: Sep. 1, 2015

(54) BACKPACK FRAME EXTENDER

(71) Applicant: Jesse Ables, Anthem, AZ (US)

(72) Inventor: Jesse Ables, Anthem, AZ (US)

(73) Assignee: Oneiros Valley LLC, Phoenix, AZ (US)

( * ) Notice: Subject to any disclaimer, the term of this patent is extended or adjusted under 35 U.S.C. 154(b) by 0 days.

(21) Appl. No.: 14/182,617

(22) Filed: Feb. 18, 2014

(65) Prior Publication Data

US 2014/0158736 A1 Jun. 12, 2014

Related U.S. Application Data

(60) Provisional application No. 61/765,395, filed on Feb. 15, 2013.

(51) Int. Cl.

| | |
|---|---|
| ***A45F 3/08*** | (2006.01) |
| ***A45F 3/10*** | (2006.01) |
| ***A45F 3/04*** | (2006.01) |

(52) U.S. Cl.

CPC ... *A45F 3/08* (2013.01); *A45F 3/04* (2013.01); *A45F 3/047* (2013.01); *A45F 3/10* (2013.01); *A45F 2003/045* (2013.01); *Y10T 29/49716* (2015.01)

(58) Field of Classification Search

CPC ..... A45F 3/06; A45F 3/08; A45F 3/10

See application file for complete search history.

(56) References Cited

U.S. PATENT DOCUMENTS

| | | | | |
|---|---|---|---|---|
| 5,292,043 | A | 3/1994 | McHale | |
| 5,615,812 | A | 4/1997 | Martin | |
| 5,704,530 | A * | 1/1998 | Scherer | 224/632 |
| 5,890,640 | A * | 4/1999 | Thompson | 224/630 |
| 7,673,777 | B2 | 3/2010 | Gleason, Jr. | |
| 8,348,114 | B2 | 1/2013 | Gleason, Jr. | |
| 8,381,956 | B2 | 2/2013 | Gleason, Jr. | |
| 8,579,171 | B2 | 11/2013 | Gleason, Jr. | |
| 2003/0192925 | A1 * | 10/2003 | Boone | 224/161 |
| 2010/0301085 | A1 * | 12/2010 | Smith | 224/637 |

OTHER PUBLICATIONS

Mystery Ranch, Ltd., Mystery Ranch website catalog, Mar. 22, 2006, 1 page, https://web.archive.org/web/20060322174655/http://www.mysteryranch.com/catalog/index.php?main_page=product_info&cPath=5_7_16&products_id=33.

U.S. Army Natick Soldier Center, USMC Pack System Drawings (2-6-0896 Shoulder Harness Assembly, 2-6-0906 Shoulder Harness), May 20, 2011, 2 pages.

Mystery Ranch 2013 Hunting Catalog, catalog, 2013, 1 page, Mystery Ranch, Ltd., Bozeman, MT.

Mystery Ranch pack photos, PDF collection, May 11, 2014, 6 pages.

Robert Looney NICE Frame Extender photos, PDF Collection, May 15, 2014, 6 pages.

* cited by examiner

*Primary Examiner* — Justin Larson

(57) ABSTRACT

One embodiment of a backpack frame extender for augmenting the length of an external backpack frame to provide longitudinally elevated connection fittings for a backpack frame load lifter straps. The backpack frame extender includes a plurality of stays and straps for attachment to a backpack frame, with a means for releasably connecting the backpack frame load lifter straps to the backpack frame extender. The attachment straps allow the backpack frame extender to be releasably attached to the backpack frame and positioned at various heights as determined by a user's torso length and personal preference. Other embodiments are described and shown.

16 Claims, 11 Drawing Sheets

BACKPACK FRAME EXTENDER

CROSS-REFERENCE TO RELATED APPLICATIONS

This application claims the benefit of Applicants' prior U.S. Provisional Application No. 61/765,395, entitled "Backpack Frame Extender," filed Feb. 15, 2013.

BACKGROUND OF THE INVENTION

Backpacks, specifically those designed to carry large loads (in terms of weight and/or bulk), typically feature two shoulder straps, two load lifter straps, a chest strap, and a hip belt. The hip belt is designed to transfer a substantial amount of the weight of the backpack from rigid or semi-rigid supports of the backpack frame to the hips of the backpack user. Each shoulder strap features a load lifter strap connecting the upper face of the shoulder strap to the backpack frame. The purpose of the load lifter strap is to pull the shoulder strap off the user's shoulders to allow the weight of the backpack to be transferred to the user's hips. The load lifter straps must be affixed to the backpack frame supports above the top of the user's shoulders (ideally two or more inches) in order to adequately lift the shoulder straps off the user's shoulders.

One embodiment relates to the Mystery Ranch, Ltd. NICE Frame, as disclosed in U.S. Pat. No. 7,673,777 to Gleason (2010). The NICE Frame is an external backpack frame comprising three vertical and three horizontal cross support members attached to a fabric membrane. An example of the NICE Frame is shown FIG. 1.

With additional reference to FIG. 2, U.S. Pat. No. 7,673,777 to Gleason (2010) further describes a spade, shown as 340 attached to a NICE Frame, comprising a semi-rigid tongue attached to a packbag or load carrier 341. The spade 340 is configured to fit in a gap between one of the frame's cross support members and the membrane 350, providing stability and assisting in transferring the load of the packbag or load carrier 341 to at least one cross support member.

The NICE Frame is designed to fit a multitude of modular packbags and accessories for load carrying purposes. An adjustable shoulder strap assembly, known as a yoke 310, is coupled with membrane 350, and a hip belt 320 is attached to the lower front of the frame. Yoke 310 is primarily designed to stabilize the backpack load and more properly position portions of the backpack relative to the user's torso and shoulders. Yoke 310 is adjustable to fit the torso length of the user relative to hip belt 320, so that the internal, semi-rigid framesheet 318 terminates near the top of the user's shoulders. Adjusted in this manner, hip belt 320 is positioned to properly transfer the weight carried by the NICE frame to the user's hips.

Yoke 310 can be adjusted so the top of framesheet 318 is above the NICE Frame's support structure. Adjusted in this manner, as is common for users with average and above-average torso lengths, load lifter straps 313 and 314 are no longer affixed to the frame optimally above the user's shoulders and are not capable of lifting the shoulder straps 311 and 312 off the user's shoulders when hip belt 320 is in use. The result is shoulder fatigue and stress on the user's spine from the weight of a loaded packbag on the frame.

The Mystery Ranch NICE 6500 packbag addresses this problem by integrating in the packbag two vertical aluminum stays which extend approximately five inches above the NICE Frame's support members. The lower sections of the aluminum stays are joined by a plastic strip that slides under the NICE Frame's center horizontal support member in the style of the spade described by Gleason, further securing and stabilizing the frame extender on the frame. Because the aluminum stays are an integral part of the packbag, the frame extending function is only provided while the packbag is attached to the NICE frame; thus, a user desiring to attach another packbag to the frame will lose the frame extending benefit of the NICE 6500 packbag. The aluminum stays cannot be removed from the packbag to reduce weight or provide additional head clearance, and damage to the internal frame extender cannot be easily repaired. The inclusion of the internal frame extender increases the complexity and manufacturing cost of the packbag.

The Mystery Ranch Metcalf packbag features an internal frame extender similar to that of the NICE 6500 packbag. It comprises two vertical carbon fiber stays joined by a lower plastic strip to form an internal extender assembly. The internal extender assembly is secured inside the packbag. The lower section of the internal extender assembly slides under the NICE Frame's center horizontal support member in the style of the internal frame extender in the NICE 6500 packbag. While the internal extender assembly can be removed from the Metcalf packbag, it cannot function as a frame extender independently of the packbag. The packbag must be constructed to retain the internal extender assembly and allow the lower section to slide under the NICE Frame's center horizontal support member, increasing the complexity and manufacturing cost of the packbag.

A NICE Frame extending panel developed in 2010 by Robert W. Looney of Bend, Oreg., shown attached to a NICE Frame in FIG. 3, is designed to function independently of a packbag. It comprises a machined aluminum panel 410 featuring numerous slots to retain straps 401 and 402 to attach the extending panel to a NICE Frame. Additional slots are provided to retain straps 403 and 404 to attach the NICE Frame load lifter straps, shown as 313 and 314 in FIG. 11, to the upper portion of the frame extending panel. The frame extending panel is attached to and stabilized on a NICE Frame without the use of a packbag by straps 401 and 402. A packbag can then be attached to the NICE frame with the frame extending panel attached. In spite of these improvements over the NICE 6500 and Metcalf packbags, the frame extending panel suffers from a number of disadvantages:

(a) The heavy, single-piece aluminum panel 410 impedes the designed flexibility of the NICE Frame's support members.

(b) Expensive routing or molding equipment must be used to fabricate panel 410. Additionally, sewn straps 401, 402, 403 and 404 must be provided in order to attach the frame extending panel to a NICE Frame, increasing manufacturing cost and logistical requirements.

(c) Damage rendering panel 410 unserviceable, as may be encountered if the backpack frame is dropped with a heavily loaded packbag, cannot be easily repaired.

(d) Camouflage or other forms of concealment (such as low-visibility colors), as may be required for hunters, military personnel and security forces, must be applied to panel 410 by paint, anodizing, fabric-like wraps or other similar methods, increasing manufacturing time and cost.

SUMMARY

In accordance with one embodiment a backpack frame extender comprises two vertical stays, each enclosed in a respective fabric-like sleeve and joined to one another by a stay connector to limit lateral movement of one vertical stay relative to the second vertical stay, with straps to attach the backpack frame extender to a backpack frame and buckles to connect to a backpack frame's load lifter strap buckles.

Advantages

Accordingly several advantages of one or more aspects are as follows:

(a) The stays may comprise semi-rigid members that do not impede the designed flexibility of the NICE Frame.

(b) Stays may comprise inexpensive, off-the-shelf, semi-rigid members (e.g. fiberglass rod or aluminum flat bar) as opposed to a panel which must be specially fabricated or molded from raw material by expensive machinery.

(c) A lightweight and easily repairable structure.

(d) The fabric-like stay sleeves can be made of materials which are low-visibility and meet military specified infrared spectral reflectance requirements (such as military camouflage fabric).

(e) Stays reduce weight over a fabricated panel by minimizing the use of dense, rigid or semi-rigid materials.

(f) The means to attach the backpack frame extender to a backpack frame, without being integrated or otherwise affixed to a packbag as with the NICE 6500, allow the backpack frame extender to be removed as desired by the user to reduce the weight or bulk of the backpack frame without also removing the packbag.

These and other advantages of one or more aspects will be apparent from a consideration of the drawings and ensuing description.

DETAILED DESCRIPTION

First Embodiment

Figure 5:
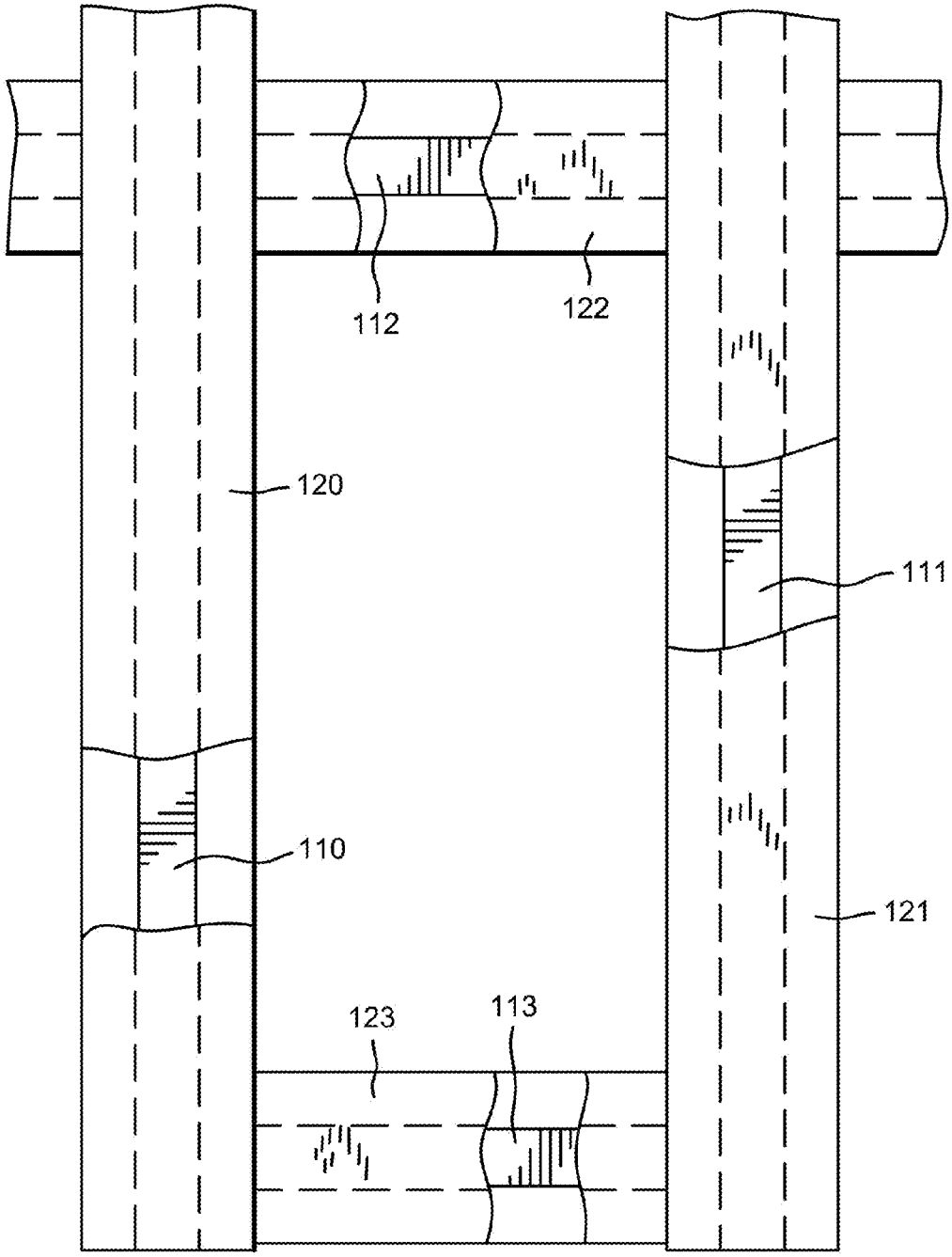
FIG. 5 illustrates a partial front elevation view showing vertical and horizontal stays in sleeves and with a portion of the sleeves cut away to reveal the stays.

Referring to the FIGURES in greater detail, and initially to FIG. 5, an apparatus for augmenting the length of a backpack frame ("backpack frame extender") includes vertical stays 110 and 111 and horizontal stays 112 and 113. The description of the backpack frame extender will use terms such as vertical and horizontal. These terms are used to describe the parts when the backpack frame extender is in its normal upright orientation.

While the backpack frame is referred to as the "NICE Frame," this term is not used in a limiting manner and other external backpack frames may be compatible with one or more embodiments, as is discussed in greater detail herein.

Figure 4:
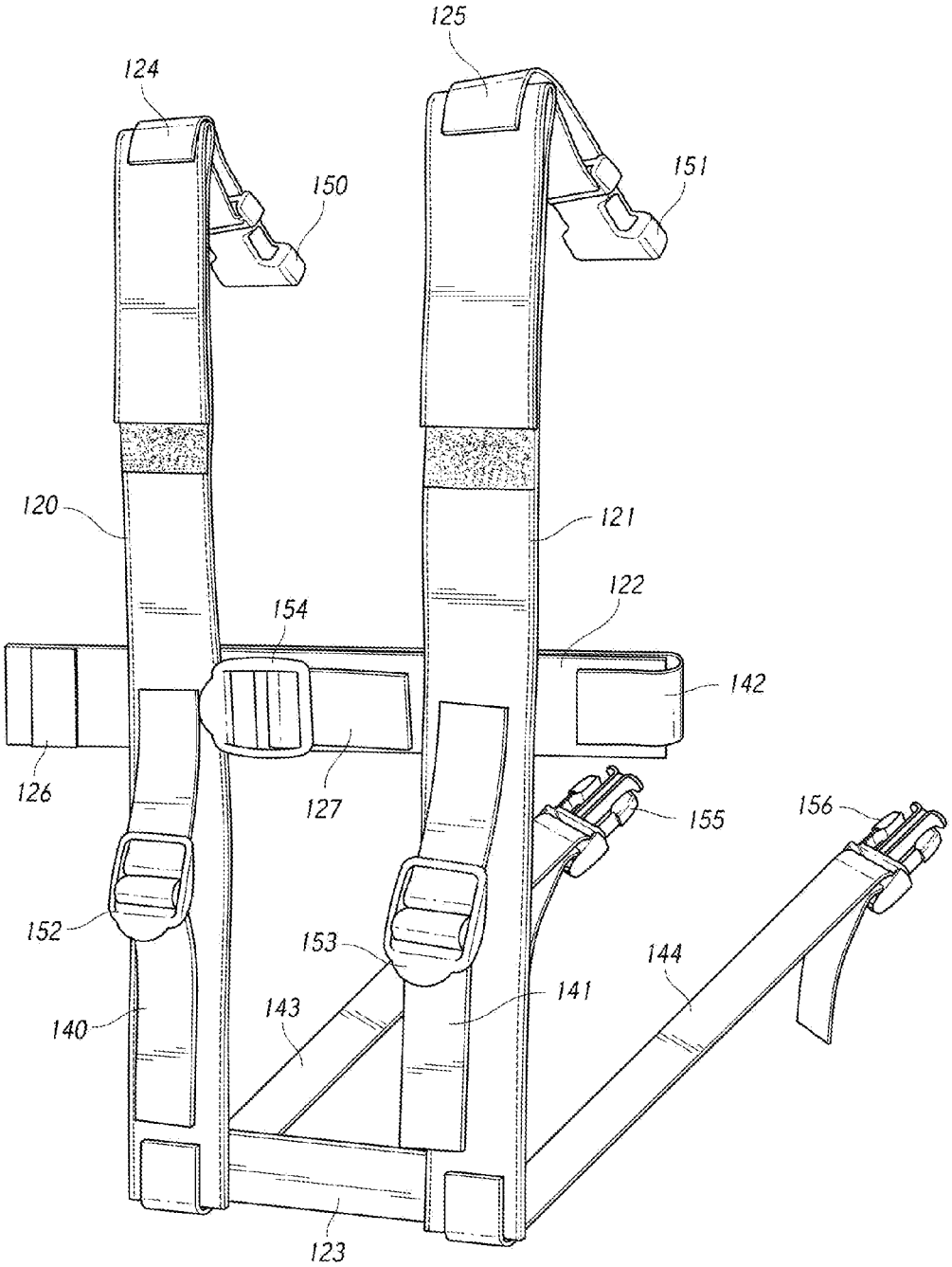
FIG. 4 is a front perspective view of a backpack frame extender in accordance with one embodiment.
Figure 6:
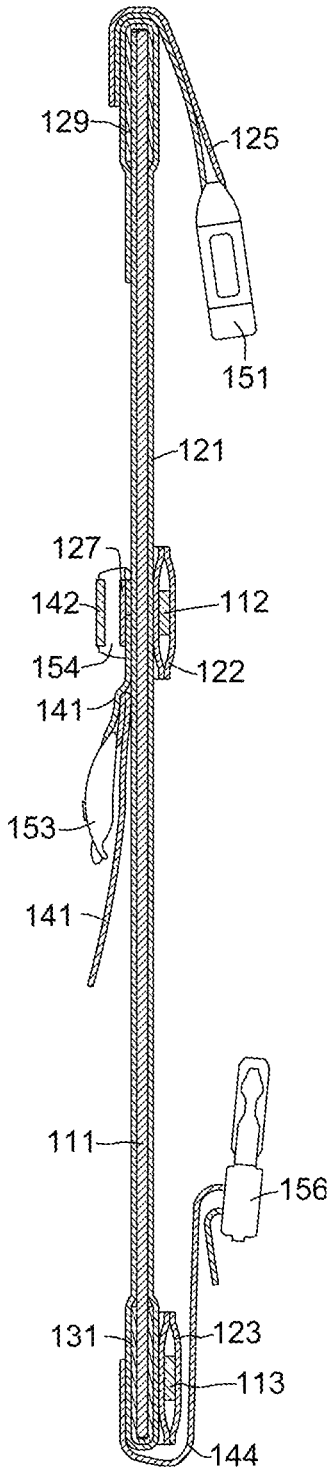
FIG. 6 is a cross-section of the backpack frame extender of FIG. 4 taken from a side elevation.

With additional reference to FIGS. 4 and 6, the backpack frame extender includes vertically oriented semi-rigid support members or stays 110 and 111 respectively encased in vertical stay sleeves 120 and 121, and horizontally oriented semi-rigid support members or stays 112 and 113 respectively encased in horizontal stay sleeves 122 and 123, forming a generally rectangular array of stays. Each of the stay sleeves 120, 121, 122, and 123 are preferably attached with two other stay sleeves 120, 121, 122, and/or 123. In one aspect, stay sleeves 120, 121, 122, and 123 have closed ends capturing a respective stay 110, 111, 112, or 113 in a respective pocket defined therein. The upper ends of vertical stay sleeves 120 and 121 may be secured by a hook and loop closure and opened to remove vertical stays 110 and 111 from respective sleeves 120 and 121. In another embodiment, the upper ends of vertical stay sleeves 120 and 121 may be permanently closed by any number of methods known in the art, such as by being stitched.

Figure 10:
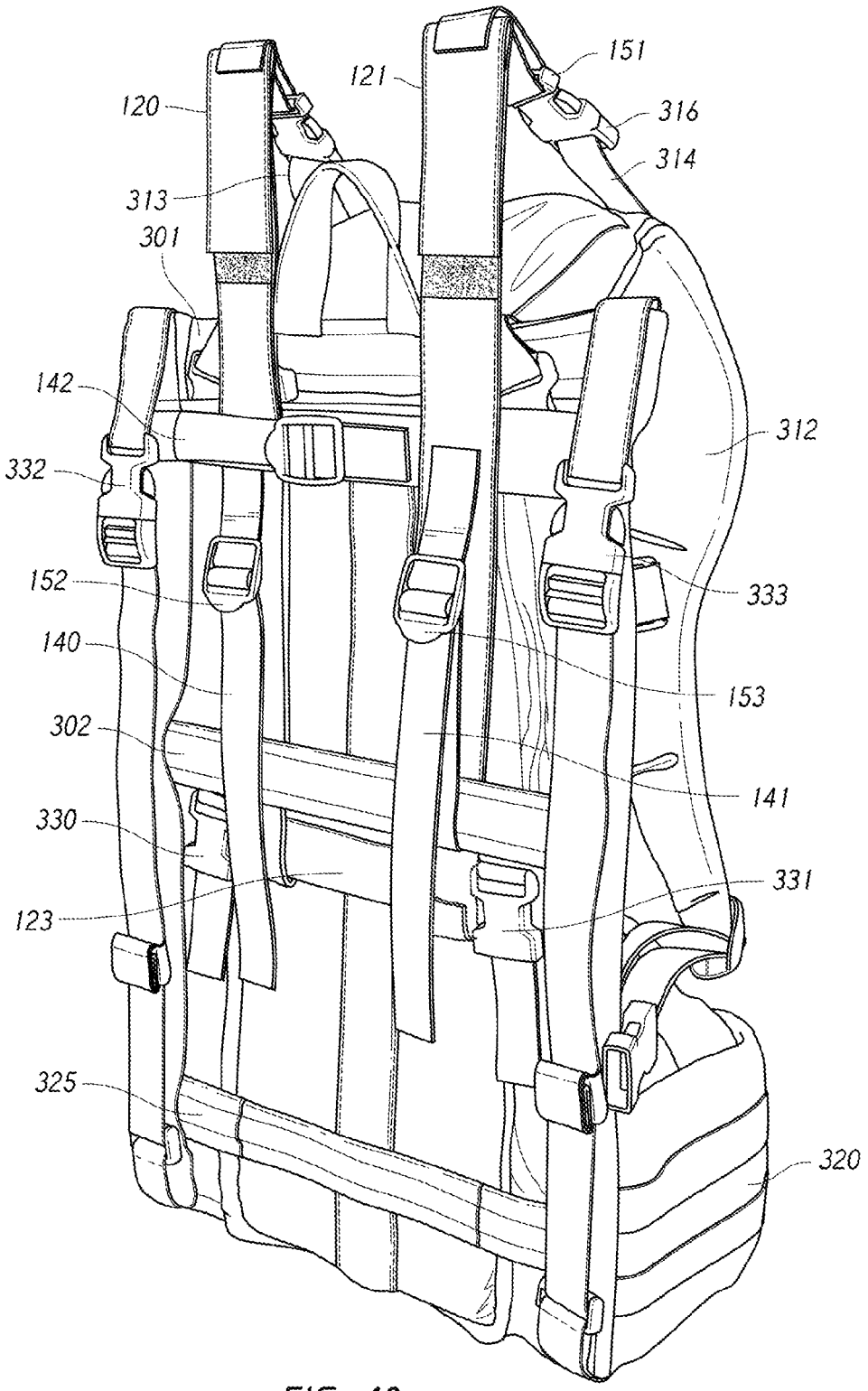
FIG. 10 shows a front perspective view of the backpack frame extender attached to the rear of the backpack frame.

In one embodiment, vertical stays 110 and 111 are positioned by stay sleeves 120 and 121 to be generally parallel with one another and achieve the vertical orientation when the backpack frame extender is in the upright position shown in FIGS. 4, 5, and 10. Horizontal stays 112 and 113 are positioned by stay sleeves 122 and 123 to be spaced from and generally parallel with one another, extending laterally across vertical stays 110 and 111 to achieve the horizontal orientation when the backpack frame extender is in the upright position. As shown in FIGS. 4, 5, and 6, sleeve 122 associated with upper horizontal stay 112 may extend laterally across and be connected to the rear face of vertical stay sleeves 120 and 121, with the middle of the length of horizontal stay 112 centered between stay sleeves 120 and 121. Sleeve 123 associated with lower horizontal stay 113 may extend laterally across and be connected to the rear face of vertical stay sleeves 120 and 121, with the middle of the length of horizontal stay 113 centered between stay sleeves 120 and 121. In this configuration as well as other embodiments, horizontal stays 112 and 113 comprise stay connectors which limit lateral movement of vertical stay 110 relative to vertical stay 111. The specific positioning of stays 110, 111, 112, and 113 described herein, as well as the number of stays, represents one embodiment that can be implemented to form the backpack frame extender. However, other configurations for the stays are contemplated by the teachings herein.

Stays 110, 111, 112, and 113 may, in one exemplary configuration, be constructed of ½-inch wide by ⅛-inch thick carbon fiber and are semi-rigid, elastically deformable, and generally straight. In another configuration, ¼-inch diameter fiberglass rod may be used to construct stays 110, 111, 112, and 113. However, other stiffening materials that are strong and rigid enough may be used to form stays 110, 111, 112, and 113. These stiffening materials may include certain types of metals, laminated wood, plastics, composites, and the like. Horizontal stays 112 and 113 may be constructed of a different stiffening material than that used in vertical stays 110 and 111, such as high-density polyethylene or polyoxymethylene, to decrease production cost or reduce the overall weight of the backpack frame extender. Stays 110, 111, 112, and 113 may be various shapes, to include cylindrical (in the style of fiberglass tube commonly used for tent poles) and rectangular (in the style of aluminum flat bar commonly used for internal frame backpacks). Stays 110, 111, 112, and 113 may, in one exemplary configuration, be generally straight longitudinally. However, in another configuration, vertical stays 110 and 111 may be constructed so that the upper portion of each vertical stay extending above the top of the NICE Frame is angled away from the user to provide additional clearance for the user's head when the NICE Frame with the backpack frame extender attached is in use.

Stay sleeves 120, 121, 122, and 123 may be constructed of durable and preferably fabric-like material, such as nylon strapping or polyester strapping similar to the material frequently used in automobile seatbelts. However, other materials such as chlorosulfonated polyethylene or chloroprene may be used to construct stay sleeves 120, 121, 122, and 123. For instance, each stay sleeve 120, 121, 122, and 123 may be constructed using one strap that is folded, so that each lateral end abuts, and sewn or welded together along its lateral edges, creating a hollow tube or pocket for housing respective stay 110, 111, 112, and 113.

In one embodiment, stay sleeves 120, 121, 122, and 123 may contain reinforcement strapping at their inner face at each lateral end to provide abrasion protection from respective stays 110, 111, 112, and 113. Such reinforcement strapping additionally facilitates in distributing across a larger area force that may be applied from the lateral ends of any stay 110, 111, 112, or 113 against a respective stay sleeve 120, 121, 122, or 123. In one exemplary configuration, the reinforcement strapping may comprise ¾-inch wide by 3-inch long strapping of the same material used to construct stay sleeves 120, 121, 122, and 123. FIG. 6 shows such reinforcement strapping as 129 and 131 positioned along the inner face of stay sleeve 121, providing reinforcement and abrasion protection for stay sleeve 121 from each lateral end of vertical stay 111.

Female side release buckles (releasable connection fittings) 150 and 151 are respectively joined to the top of each vertical stay sleeve 120 and 121, as shown in FIGS. 4 and 6. Buckles 150 and 151 may be National Molding part no. 5001, ITW Nexus part no. 810-1057, or any similar hardware that releasably connects to male buckles 315 and 316 on the NICE Frame. Alternatively, buckles 150 and 151 may be ladderlock buckles, such as National Molding part no. 4199, ITW Nexus part no. 104-0100, or any similar hardware that allows load lifter straps 313 and 314 to be secured through an adjustable portion of the hardware when male buckles 315 and 316 are removed from load lifter straps 313 and 314.

Figure 11:
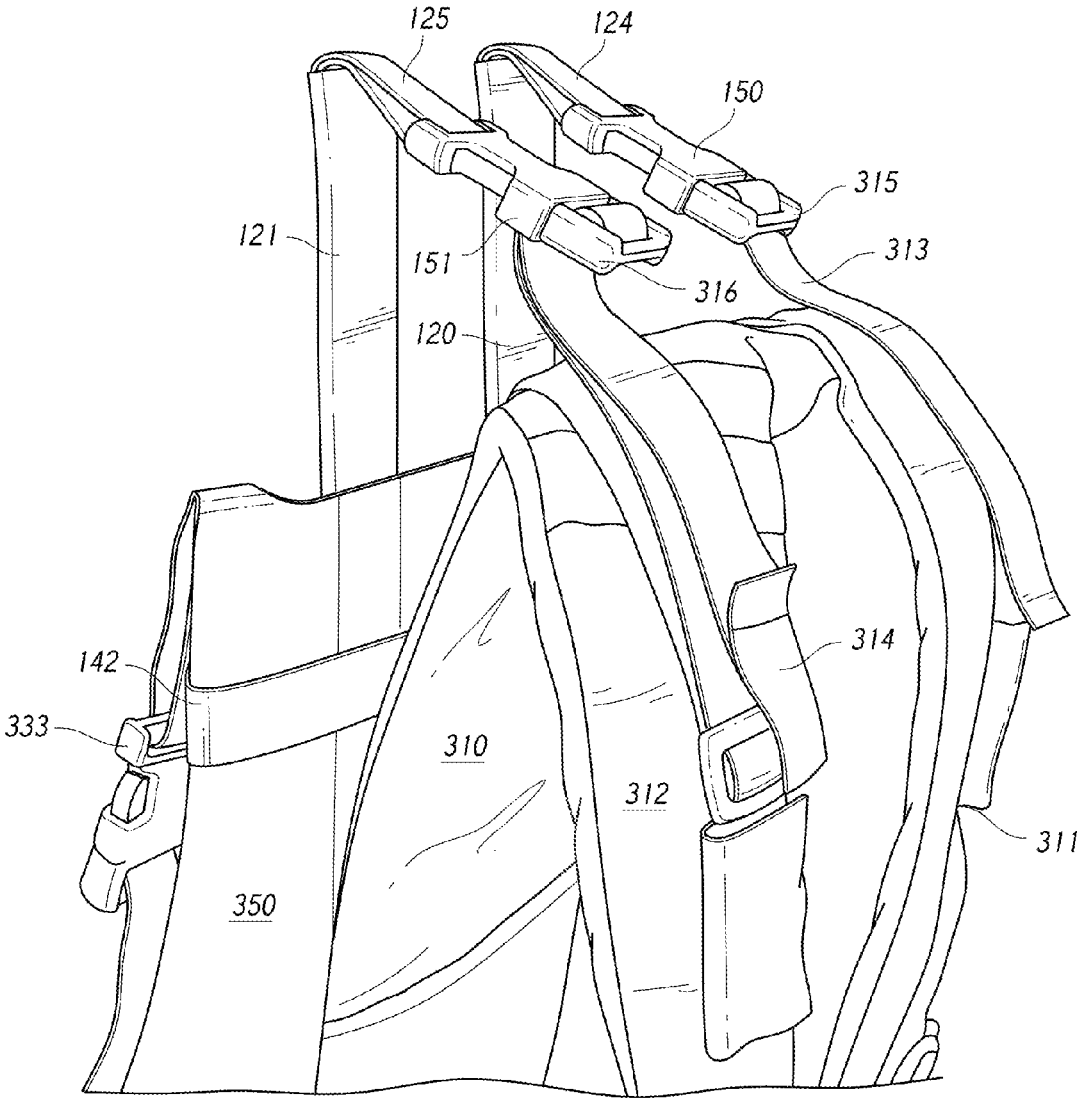
FIG. 11 is a rear perspective view of the backpack frame extender with backpack frame load lifter straps attached.

With additional reference to FIG. 11, strap 124 partially encircles the rear attachment bar on buckle 150. Each lateral end of strap 124 is abutted and strap 124 joined to the front face of vertical stay sleeve 120, so that strap 124 overlies the top of stay 110. The straps 124 and 125 may be joined to respective stay sleeves 120 and 121 by sewing, welding, or any number of methods known in the art. Strap 125 partially encircles the rear attachment bar on buckle 151. Each lateral end of strap 125 is abutted and strap 125 joined to the front face of vertical stay sleeve 121 so that strap 125 overlies the top of stay 111 in the manner shown in FIG. 6. The joining of straps 124 and 125 to respective stay sleeves 120 and 121 is such that respective buckles 150 and 151 are permanently affixed to straps 124 and 125.

As illustrated in FIGS. 4, 6, and 10, one end of each upper retention or attachment straps 140 and 141 may be sewn or otherwise joined to the front face of respective vertical stay sleeves 120 and 121 approximately where horizontal stay sleeve 122 extends laterally across sleeves 120 and 121. Ladderlock buckles 152 and 153 are provided to secure the free ends of each respective upper attachment strap 140 and 141. Ladderlock buckles 152 and 153 may be National Molding part no. 4199, ITW Nexus part no. 154-0075 or 104-0100, or any similar hardware that allows upper attachment straps 140 and 141 to be adjustably secured through a portion of the hardware.

Figure 7:
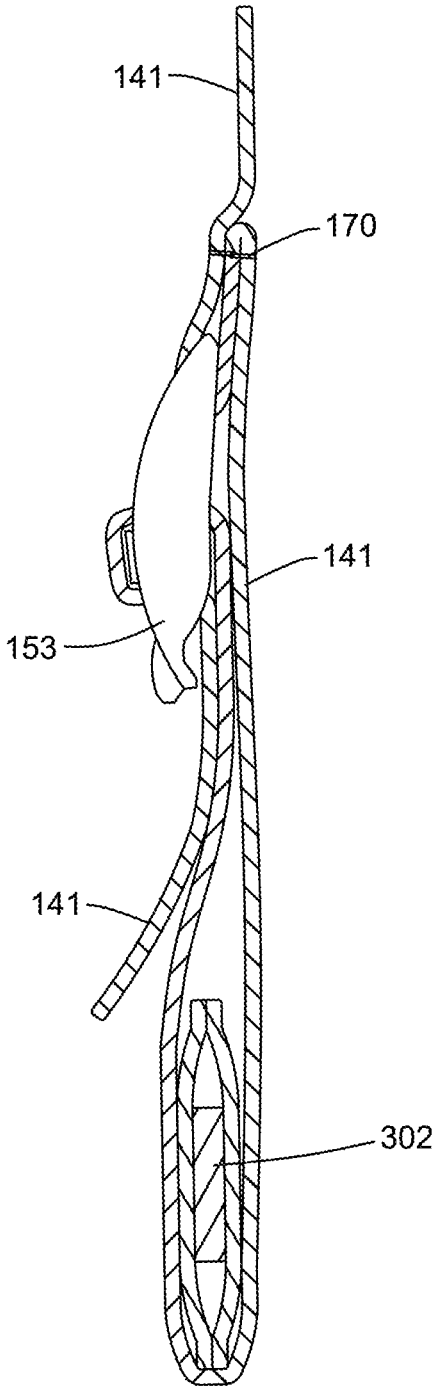
FIG. 7 is a cross-section taken from a side elevation of an upper attachment strap of the backpack frame extender of FIG. 6 partially encircling a backpack frame's horizontal support member.

Upper attachment straps 140 and 141 may be constructed so that ladderlock buckles 152 and 153 are respectively fixed to straps 140 and 141. As illustrated in FIG. 7, upper attachment strap 141 is folded so that it loops around a rear attachment bar on ladderlock buckle 153 and the folds secured by stitching 170. The free end of each upper attachment strap 140 and 141 is then able to loop around one of the NICE Frame's horizontal support members 302 or 325, such as support member 302 illustrated in FIG. 7.

Upper attachment straps 140 and 141 may be of a different width than that of lower retention or attachment straps 143 and 144, as desired to reduce weight or manufacturing costs. Ladderlock buckles 152 and 153 are provided to match the width of the respective upper attachment straps 140 and 141. For example, if upper attachment strap 140 is constructed of ¾-inch wide strapping, its accompanying ladderlock buckle 152 must be designed to accommodate strapping of approximately the same width through its adjustment section.

As illustrated in FIGS. 4 and 6, each respective one end of lower attachment straps 143 and 144 may be sewn or otherwise joined to the front face of stay sleeves 120 and 121. With additional reference to FIG. 9, the free ends of lower attachment straps 143 and 144 are routed through the adjustment sections of respective male side release buckles 155 and 156. Buckles 155 and 156 may be National Molding part no. 5000, ITW Nexus part no. 810-1058, or any similar hardware that releasably connects to the female side release buckles on the NICE Frame (National Molding part no. 8762 or similar) and allows lower attachment straps 143 and 144 to be adjustably secured through a section of the hardware. The adjustment portion of each buckle 155 and 156 must accommodate the width of lower attachment straps 143 and 144. For example, if lower attachment straps 143 and 144 are constructed of 1-inch wide strapping, buckles 155 and 156 must accommodate strapping of approximately the same width through their adjustment section.

Horizontal retention or attachment strap 142 may be sewn or otherwise joined to one lateral end of the front face of upper horizontal stay sleeve 122. As shown in FIG. 4, horizontal attachment strap 142 is joined near the right end of the front face of horizontal stay sleeve 122. Strapping 127 is looped around an attachment bar on ladderlock buckle 154. Ladderlock buckle 154 may be National Molding part no. 4199, ITW Nexus part no. 154-0075 or 104-0100, or any similar hardware that allows horizontal attachment strap 142 to be adjustably secured through a section of the hardware. Each lateral end of strapping 127 is abutted and strap 127, joined to ladderlock buckle 154 as described above, is sewn or otherwise joined to the front face of upper horizontal stay sleeve 122 near the center of horizontal stay sleeve 122. The joining of strapping 127 to upper horizontal stay sleeve 122 is such that ladderlock buckle 154 is permanently affixed to strapping 127. Horizontal attachment strap 142 is provided to wrap laterally around the NICE Frame and secure through the adjustment portion of ladderlock buckle 154. Horizontal attachment strap 142 may be of a different width than that of lower attachment straps 143 and 144. Ladderlock buckle 154 is provided to match the width of associated horizontal attachment strap 142. For example, if horizontal attachment strap 142 is constructed of ¾-inch wide strapping, its accompanying ladderlock buckle 154 must be designed to accommodate strapping of approximately the same width through its adjustment section.

Figure 8:
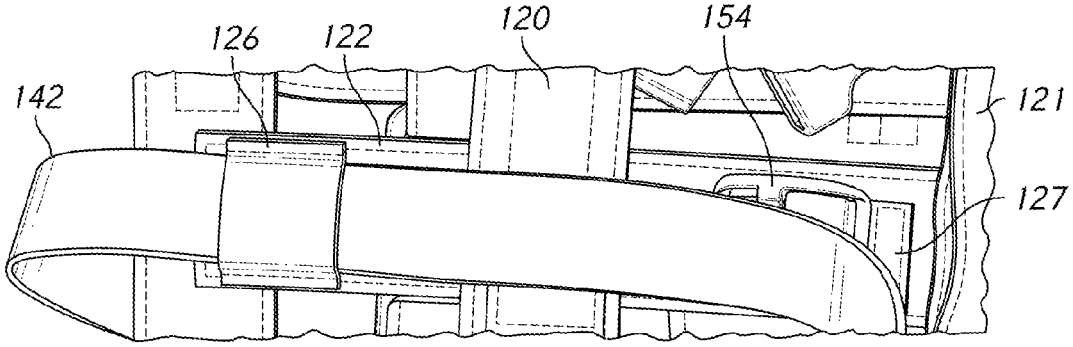
FIG. 8 is a front view of horizontal attachment components of the backpack frame extender.

With continued reference to FIG. 4, strapping loop 126 is joined to the end of the front face of upper horizontal stay sleeve 122 opposite the end to which horizontal attachment strap 142 is joined. As shown in FIG. 8, strapping loop 126 is sewn or otherwise joined at its upper and lower longitudinal ends to upper horizontal stay sleeve 122 to provide an open loop through which horizontal attachment strap 142 may pass.

In one embodiment, strapping 124, 125, 126, 127, 140, 141, 142, 143, and 144 are constructed of the same material used to construct stay sleeves 120, 121, 122, and 123. However, strapping 124, 125, 126, 127, 140, 141, 142, 143, and 144 may be constructed of any durable and preferably fabric-like material, such as nylon strapping, polyester strapping, polypropylene strapping, or strapping constructed from materials such as chlorosulfonated polyethylene or chloroprene.

Operation

Figure 2:
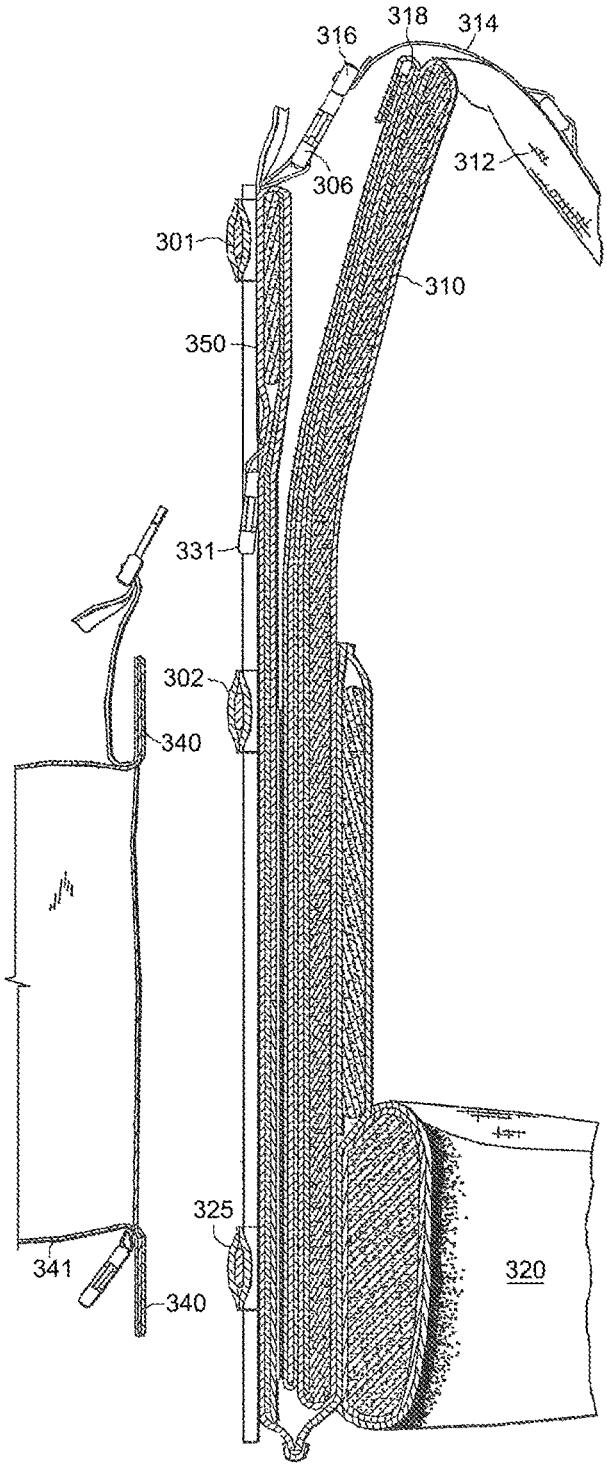
FIG. 2 (PRIOR ART)
FIG. 2 is a cross-section of the backpack frame of FIG. 1 taken from a side elevation with a packbag detached from the frame.
Figure 3:
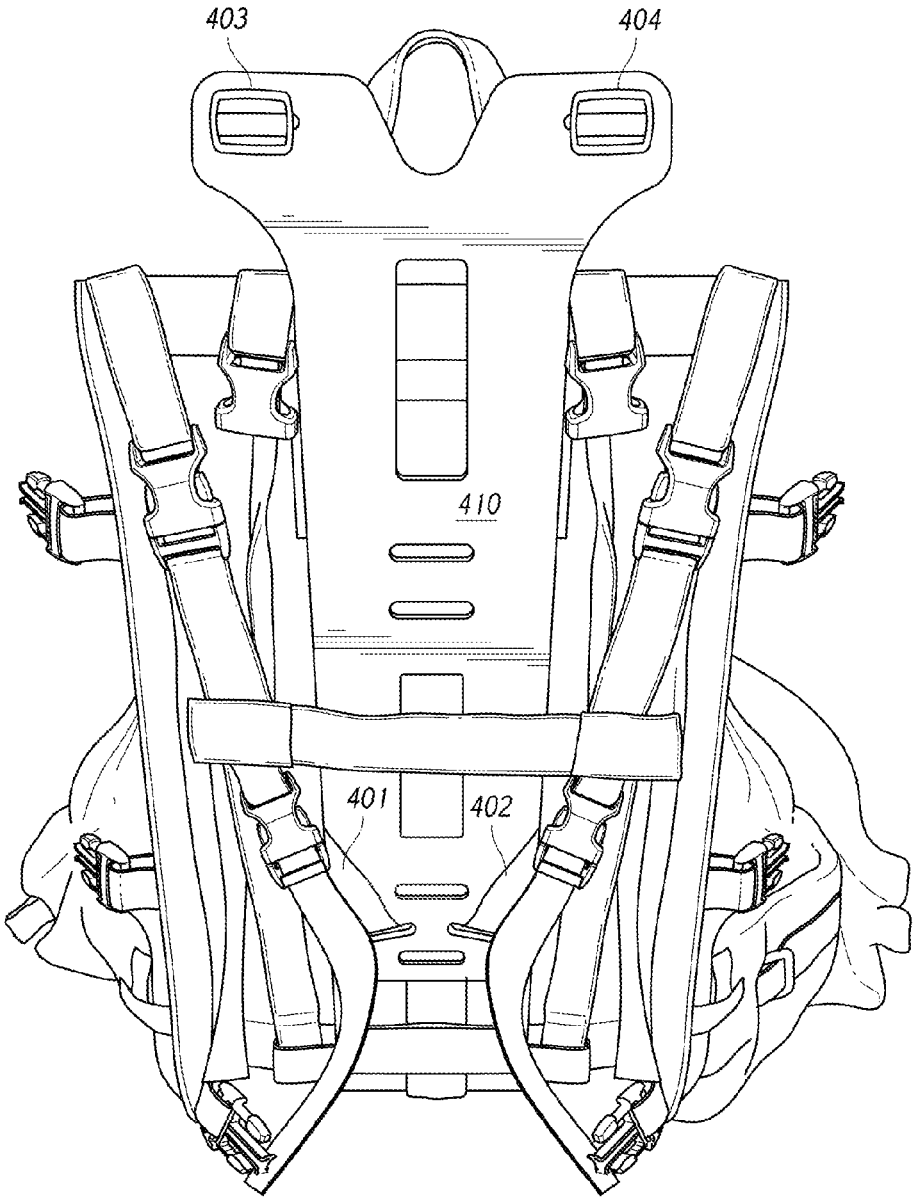
FIG. 3 (PRIOR ART)
FIG. 3 shows a backpack frame extending panel designed by Robert W. Looney attached to the backpack frame.

Referring initially to FIG. 2, NICE Frame yoke 310 may be adjusted so the top of the integrated framesheet 318 in yoke 310 is above upper horizontal support member 301. Adjusted in this manner, load lifter straps 313 and 314 are no longer affixed to the NICE Frame optimally above the user's shoulders and are not capable of lifting shoulder straps 311 and 312 off the user's shoulders when hip belt 320 is in use.

In FIGS. 10 and 11, the backpack frame extender is shown attached to the rear of the NICE Frame. The top of vertical stays 110 and 111, respective stay sleeves 120 and 121, and buckles 150 and 151 are seen extended vertically above the top of the NICE Frame, specifically above upper horizontal support member 301. Female side release buckles 150 and 151 connect to male buckles 315 and 316. Load lifter straps 313 and 314 are routed through the adjustment section of respective male buckles 315 and 316, allowing the user to adjust the tension of load lifter straps 313 and 314 to stays 110 and 111 by altering the length of each respective free end of load lifter straps 313 and 314 through the adjustment section of the respective male buckles 315 and 316. This altering of the length of each free end of load lifter straps 313 and 314 pulls shoulder straps 311 and 312 upward off the user's shoulders, allowing the weight of a loaded packbag or load carrier borne by the NICE Frame to be transferred to the user's hips via hip belt 320. Thus, the backpack frame extender provides longitudinally elevated connection fittings for load lifter straps 313 and 314.

In one embodiment, lower horizontal stay sleeve 123 and a portion of vertical sleeves 120 and 121 are fit in the gap between center horizontal support member 302 and the rear face of the NICE Frame comprising fabric membrane 350, as shown in FIG. 10. Positioning the frame extender in this manner between center horizontal support member 302 and membrane 350 allows rearward force applied to the upper portion of vertical stays 110 and 111, as encountered when load lifter straps 313 and 314 are tightened by the user, to be transferred to center horizontal support member 302. This positioning of the backpack frame extender thus prevents a cantilever effect of the backpack frame extender pivoting longitudinally on upper horizontal support member 301 when said rearward force is applied to vertical stays 110 and 111.

In an alternative attachment method, the backpack frame extender is positioned in atop center horizontal support member 302 with lower attachment straps 143 and 144 partially encircling center horizontal support member 302 so as to pass through the gap between center horizontal support member 302 and membrane 350 before respective male buckles 155 and 156 are connected to any of female buckles 303, 304, 305, 306, 330, 331, 332, or 333. Attached in this manner, I conceive the cantilever effect described above may be prevented without placing any portion of the backpack frame extender between any horizontal support member 301, 302, and 325 and membrane 350.

Referencing FIGS. 7 and 10, upper attachment straps 140 and 141 are provided to partially encircle the NICE Frame's center horizontal support member 302 or lower horizontal support member 325. The free ends of upper attachment straps 140 and 141 are then routed through the respective adjustment sections of ladderlock buckles 152 and 153 to prevent generally upward movement of the backpack frame extender on the NICE Frame. The adjustment sections of ladderlock buckles 152 and 153 provide a means to adjust the height of the backpack frame extender on the NICE Frame by altering the length of upper attachment straps 140 and 141 through the respective adjustment sections of each ladderlock buckle 152 and 153. Per one embodiment, FIG. 7 shows upper attachment strap 141 partially encircling center horizontal support member 302 and secured through the adjustment section of ladderlock buckle 153.

Figure 1:
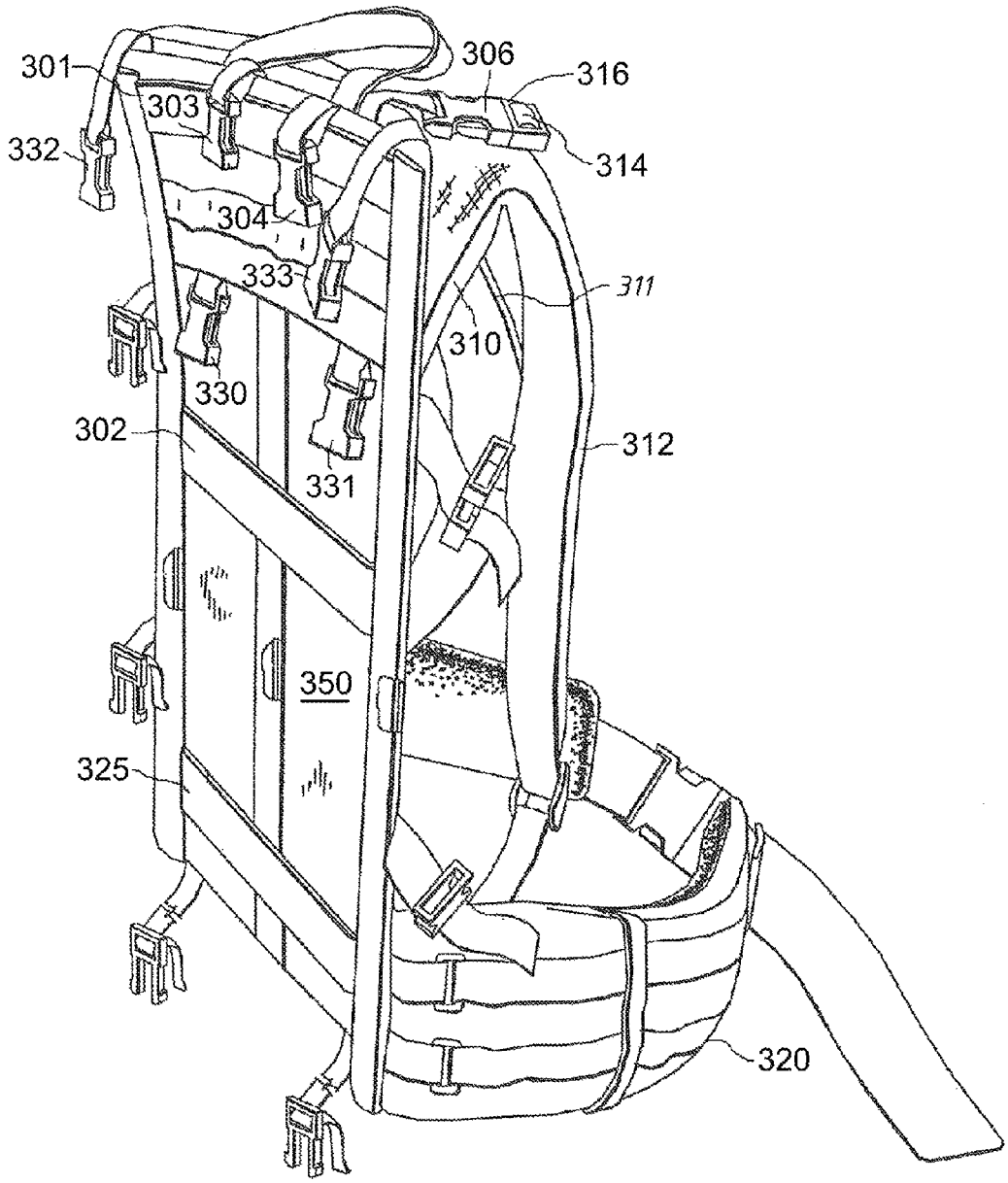
FIG. 1 (PRIOR ART)
FIG. 1 is a perspective view of a backpack frame.
Figure 9:
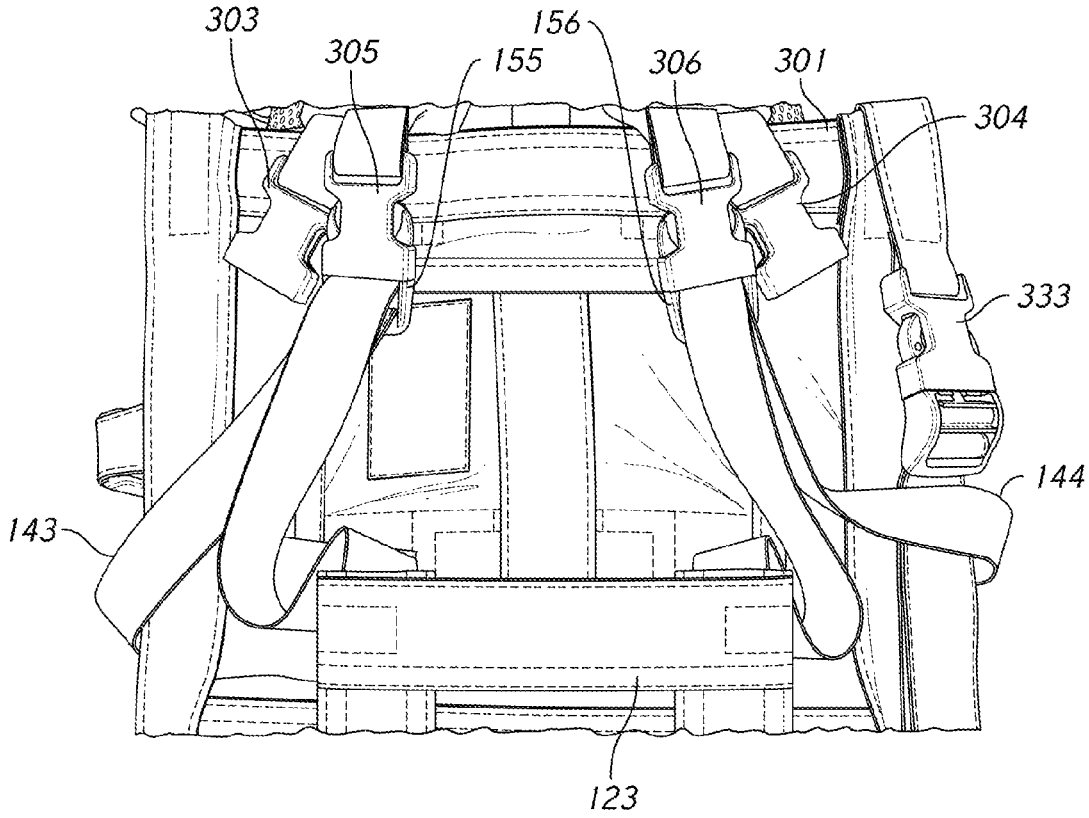
FIG. 9 is a rear view of the backpack frame with lower attachment straps connected to the backpack frame.

Buckles 155 and 156, shown in FIGS. 4 and 9 with lower attachment straps 143 and 144 routed through their respective adjustment sections, may connect to the NICE Frame's integrated load lifter female buckles 305 and 306 to prevent generally downward movement of the backpack frame extender on the NICE Frame. Buckles 305 and 306 are affixed to the upper edge of upper horizontal support member 301, providing an optimal point at which downward force applied to the attached backpack frame extender is transferred to the support members of the NICE Frame. FIGS. 1 and 9 illustrate alternative female buckles 303, 304, 330, 331, 332, and 333 to which male buckles 155 and 156 can connect. The adjustment sections of buckles 155 and 156 provide a means to adjust the height of the backpack frame extender on the NICE Frame by altering the length of lower attachment straps 143 and 144 through the respective adjustment sections of buckles 155 and 156.

When the backpack frame extender is attached to the NICE Frame as described above, the combination of upward tension created by tightening lower attachment straps 143 and 144 through buckles 155 and 156 and downward tension created by tightening upper attachment straps 140 and 141 through buckles 152 and 153 firmly positions the backpack frame extender at a particular height on the NICE Frame. Additionally, this combination of tension forces provides stability for the backpack frame extender by limiting lateral (side-to-side) movement of the backpack frame extender on the NICE Frame.

In one embodiment, upper horizontal stay 112 and respective horizontal stay webbing 122 are provided to correspond to the width of the outermost NICE Frame support members so that upper horizontal stay 112 limits lateral (side-to-side) movement of the backpack frame extender on the NICE Frame. As shown in FIGS. 8 and 11, horizontal attachment strap 142 partially laterally encircles the NICE Frame and is routed through strapping loop 126 before attaching through the adjustment section of ladderlock buckle 154. Strapping loop 126 serves to maintain the position of horizontal attachment strap 142 atop the front face of upper horizontal stay sleeve 122. This positioning of horizontal attachment strap 142 ensures the compression force produced by secured horizontal attachment strap 142 through ladderlock buckle 154 is at least partially transferred to upper horizontal stay 112. This compression force helps the backpack frame extender secure stably to the rear face of the NICE Frame, which includes upper horizontal support member 301 and membrane 350.

When the backpack frame extender is attached to the NICE Frame, as shown in FIGS. 10 and 11, it allows load lifter straps 313 and 314 to lift shoulder straps 311 and 312 upward, off the user's shoulders, allowing the weight of a loaded packbag or load carrier borne by the NICE Frame to be transferred to the user's hips via hip belt 320. The height of the backpack frame extender on the NICE Frame can be adjusted to provide adequate lift of shoulder straps 311 and 312 based on yoke's 310 adjusted height relative to the user's torso length. Ideally, the height of the backpack frame extender on the NICE Frame is such that adequate lift is provided for shoulder straps 311 and 312 without being higher than necessary, so vertical stays 110 and 111 do not interfere with the user's head or catch on foliage. One example of an adjustment of the backpack frame extender places the top end of stays 110 and 111 approximately 2 inches above the top of framesheet 318. The height of the backpack frame extender can also be adjusted so as to not interfere with a helmet that may be worn by the user, such as a soldier or firefighter.

I conceive the backpack frame extender may be used as part of a modular packbag system, wherein packbags may be modified or otherwise constructed to integrate with or attach to the backpack frame extender on the NICE Frame. Such integration may provide improved structure of the packbag above the top of the NICE Frame support members by providing semi-rigid support for this upper portion of the packbag. Additionally, I conceive the backpack frame extender may provide mounting options for backpack accessories and related accessories. For example, a pouch may be constructed with attachment straps which secure around vertical stays 110 and 111. A sling attached to a rifle may be slung around one of the vertical stays 110 or 111 to hold the rifle to the frame.

In one possible sequence of attaching and adjusting the backpack frame extender to the NICE Frame, male buckles 155 and 156 are first respectively connected to female buckles 305 and 306, as shown in FIG. 9. Second, lower horizontal stay 113 and the lower ends of vertical stays 110 and 111 are positioned between center horizontal support member 302 and membrane 350. Third, upper attachment straps 140 and 141 are partially encircled around center horizontal support member 302 and secured through the adjustment sections of respective ladderlock buckles 152 and 153. Fourth, horizontal attachment strap 142 is wrapped leftwardly around the front of the NICE Frame, as shown in FIG. 11, before being passed through strapping loop 126 and loosely secured to ladderlock buckle 154, as shown FIG. 8. Fifth, the backpack frame extender is affixed to the NICE Frame at the position desired by the user by tightening straps 140, 141, 143, and 144 with the backpack frame extender held at the desired position. Sixth, horizontal attachment strap 142 is tightened and thus fully secured to ladderlock buckle 154 to limit lateral movement of the backpack frame extender on the NICE Frame. Thus, the backpack frame extender is releasably attached to the NICE Frame. Seventh, male buckles 315 and 316, associated with load lifter straps 313 and 314, are connected to respective female buckles 150 and 151. The sequence above is provided for reference only and the backpack frame extender can be adjusted and attached to the NICE Frame in any number of sequences depending on user preference, embodiment, external backpack frame model, etc.

Additional Embodiments

Figure 12:
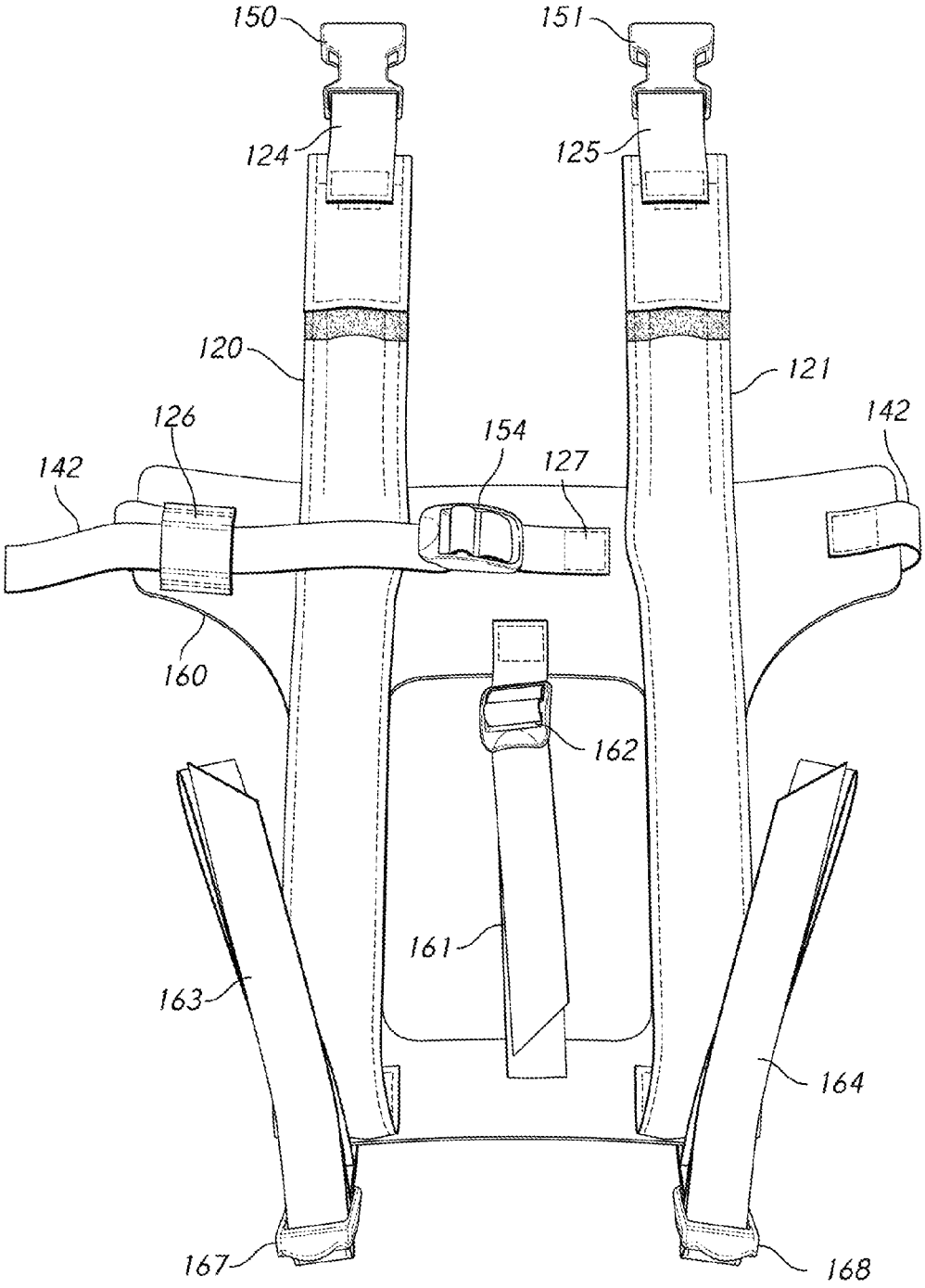
FIG. 12 is a front view of a backpack frame extender in accordance with another embodiment.

As shown in FIG. 12, upper attachment straps 140 and 141 and respective ladderlock buckles 152 and 153, shown in FIG. 4, may be replaced by a single center attachment strap 161 and accompanying ladderlock buckle 162. The use of center attachment strap 161 in lieu of two upper attachment straps 140 and 141 eases attachment of the backpack frame extender to the NICE Frame by reducing the number of steps required to attach it, while additionally easing manufacturing burden by reducing materials and construction time.

Lower attachment straps 143 and 144 and respective male buckles 155 and 156, shown in FIG. 4, may be replaced by attachment straps 163 and 164 and respective ladderlock buckles 167 and 168, as shown in FIG. 12. Provided in this manner, attachment straps 163 and 164 may partially encircle center horizontal support member 302 and secure through the corresponding adjustment sections of ladderlock buckles 167 and 168 in the manner illustrated in FIG. 7 by upper attachment strap 141 and ladderlock buckle 153. The partial encirclement of attachment straps 163 and 164 around center horizontal support member 302 prevents generally downward movement of the backpack frame extender on the NICE Frame.

I conceive that one or more aspects of a backpack frame extender can attach or be adapted to attach to a multitude of external backpack frames, especially those featuring numerous slots for positioning suspension components (such as shoulder straps) and attaching load carrying accessories. Examples of such external backpack frames include those described in U.S. Pat. No. 3,938,718 to Madison (1976), U.S. Pat. No. 5,762,243 to McMaster (1998), U.S. Pat. No. 7,644,847 to Howell (2010), and U.S. Pat. No. 7,793,809 to Howell (2010).

CONCLUSION

From the foregoing, it may be seen that the backpack frame extender of the present embodiments is particularly well suited for the proposed usages thereof. Furthermore, since certain changes may be made in the above embodiments without departing from the scope hereof, it is intended that all matter contained in the above description or shown in the accompanying drawing be interpreted as illustrative and not in a limiting sense. It is also to be understood that the following claims are to cover certain generic and specific features described herein.

I claim:

1. An apparatus for augmenting the length of a backpack frame, comprising:

two generally upright stays in spaced apart relationship and having opposite ends;

stay connector having at least portions extending between the upright stays;

first means for attaching lower portion of said apparatus to said backpack frame;

second means for attaching upper portion of said apparatus to said backpack frame;

third means for attaching load lifter straps of said backpack frame to said upright stays.

2. The apparatus of claim 1 including sleeves each receiving a respective upright stay therein, said sleeves each having opposite closed ends with a respective said upright stay being captured between opposite closed ends.

3. The apparatus of claim 2 wherein the upright stays being semi-rigid members.

4. The apparatus of claim 1 wherein the stay connector affixing the upright stays comprising a semi-rigid member extending between said upright stays and operable to limit relative movement in a lateral direction of one said upright stay relative to the second said upright stay.

5. The apparatus of claim 1 wherein the first means for attaching the lower portion of said apparatus to the backpack frame comprising at least one lower retention strap.

6. The apparatus of claim 5 wherein the lower retention strap being formed at least partially of fabric.

7. The apparatus of claim 6 wherein the first means for attaching said apparatus further comprising at least one connection fitting.

8. The apparatus of claim 7 wherein the lower retention strap received in a gap formed between a rearwardly facing surface of the backpack frame and a generally horizontal support member that overlies said rearwardly facing surface, said lower retention strap releasably securing to said generally horizontal support member by the connection fitting to prevent substantial downward movement of said apparatus on said backpack frame.

9. The apparatus of claim 1 wherein the second means for attaching the upper portion of said apparatus to the backpack frame comprising at least one upper retention strap.

10. The apparatus of claim 9 wherein the upper retention strap being formed at least partially of fabric.

11. The apparatus of claim 10 wherein the second means for attaching said apparatus further comprising an upper connection fitting.

12. The apparatus of claim 11 wherein the upper retention strap received in the gap formed between the rearwardly facing surface of the backpack frame and the generally horizontal support member that overlies said rearwardly facing surface, said upper retention strap at least partially laterally encircling said generally horizontal support member and releasably secured to the upper connection fitting to prevent substantial upward movement of said apparatus on said backpack frame.

13. The apparatus of claim 1 further including a generally horizontal retention strap, a lateral end of said horizontal retention strap affixed to a lateral end of the stay connector, wherein said horizontal retention strap overlies the forwardly facing surface of the backpack frame and at least partially encircling the width of said backpack frame to attach to a horizontal connection fitting on a generally center section of said stay connector.

14. The apparatus of claim 1 wherein the third means for attaching the load lifter straps of the backpack frame to the upright stays comprising a first releasable connection fitting and a second releasable connection fitting.

15. The apparatus of claim 14 wherein the first releasable connection fitting affixed to the first upright stay by a respective first connection fitting retention strap and the second releasable connection fitting affixed to the second upright stay by a respective second connection fitting retention strap.

16. A method of augmenting the length of a backpack frame comprising:

an apparatus providing at least one longitudinally elevated connection fitting relative to the length of said backpack frame for backpack frame load lifter straps when said backpack frame is in its normal upright orientation;

means for attaching said backpack frame load lifter straps to said apparatus comprising at least one said connection fitting and at least one corresponding connection fitting retention strap;

means for attaching said apparatus to said backpack frame providing a variable longitudinal increase of said connection fitting above said backpack frame;

means for providing generally lateral stability of said apparatus on said backpack frame.

* * * * *